US005695380A

United States Patent [19]

Morrison

[11] Patent Number: 5,695,380

[45] Date of Patent: Dec. 9, 1997

[54] METHOD FOR ATTACHING AN OBJECT

[76] Inventor: Juanita A. Morrison, 4605 N. Penn. Ave. 2-D, Oklahoma City, Okla. 73112-8934

[21] Appl. No.: 493,335

[22] Filed: Jun. 21, 1995

[51] Int. Cl.[6] ..... A63H 3/36

[52] U.S. Cl. ..... 446/268; 446/72; 446/390

[58] Field of Search ..... 446/71, 72, 268, 446/390; 24/3.13, 3.3, 324, 518; 224/218–222, 267

[56] References Cited

U.S. PATENT DOCUMENTS

| | | | |
|---|---|---|---|
| Re. 28,289 | 12/1974 | Calkins | 224/219 |
| 1,431,482 | 10/1922 | Overholt | 446/268 |
| 1,482,647 | 2/1924 | Gise | 224/219 |
| 1,544,267 | 6/1925 | Munson | 446/268 |
| 1,551,050 | 8/1925 | Parsons . | |
| 3,148,812 | 9/1964 | Hilsinger | 24/3.3 |
| 3,696,553 | 10/1972 | Lewis et al. . | |
| 3,731,427 | 5/1973 | Lewis et al. . | |
| 3,942,194 | 3/1976 | Winter | 224/219 |
| 4,148,424 | 4/1979 | Fortenberry | 224/218 |
| 4,198,989 | 4/1980 | Hawke | 224/222 |
| 4,728,123 | 3/1988 | Kassal | 224/220 |
| 4,729,751 | 3/1988 | Schiavo et al. | 446/268 |
| 4,856,149 | 8/1989 | Brame | 224/220 |
| 4,865,239 | 9/1989 | Timbrook | 224/220 |
| 4,982,885 | 1/1991 | Severson | 24/324 |
| 5,071,385 | 12/1991 | Cox | 446/369 |
| 5,257,729 | 11/1993 | Silvernail | 224/219 |
| 5,433,643 | 7/1995 | Pratt | 446/268 |

FOREIGN PATENT DOCUMENTS

| | | | |
|---|---|---|---|
| 999367 | 1/1952 | France | 224/267 |
| 24107 | of 1894 | United Kingdom | 224/220 |
| 187 | of 1907 | United Kingdom | 224/220 |

*Primary Examiner*—Robert A. Hafer
*Assistant Examiner*—Jeffrey D. Carlson
*Attorney, Agent, or Firm*—McKinney, Stringer & Webster, P.C.

[57] ABSTRACT

A new and improved adjustable object-holding accessory for dolls and other toy figures, comprised of interlocking straps (10 and 10'), one strap being releasably fastened around the hand of a toy figure and the other strap being releasably fastened around the object to be juxtaposed to the hand of the toy, the interlocking portions of the straps (10 and 10') being positioned at or near the palm of the toy's hand, thus enabling the doll or other toy figure to appear to be holding the object.

4 Claims, 2 Drawing Sheets

12b
14
12a
10
28c
28b
28a
26a
26b

14'
10'

18
16
20
12a
10

METHOD FOR ATTACHING AN OBJECT

BACKGROUND—FIELD OF THE INVENTION

This invention relates to accessories for dolls and other toy figures.

BACKGROUND—DESCRIPTION OF PRIOR ART

Children derive joy and entertainment from manipulating dolls in ways that cause the toys to mimic human activities. A toy figure which can be made to appear to hold an object in its hand, for example, is intriguing to girls and boys alike.

Many patents have been issued for means by which an object can be releasably attached to a toy figure. Almost all of these patents disclose attachment means permanently affixed to the toy, with corresponding attachment means permanently affixed to the object or objects to be held. Several of these patents relate to objects attached to the hands of a doll.

For example, U.S. Pat. No. 1,551,050 to Parsons (1925) discloses magnetic devices permanently affixed in the hands of a doll, by which means the doll can hold objects which are outfitted with attracting magnetic devices. U.S. Pat. No. 3,696,553 to Lewis et al (1972) and U.S. Pat. No. 3,731,427 to Lewis et al (1973) also disclose magnets used in doll hands designed to magnetically grasp attractable objects. U.S. Pat. No. 5,071,385 to Cox (1991) discloses magnets disposed in the paws of an animal toy to pose the limbs of the toy.

Relying on a different attracting means, U.S. Pat. No. 4,729,751 to Schiavo et al (1988) discloses hook-and-loop material permanently affixed to a doll's hands and to objects the doll is intended to hold.

Since magnetic devices, hood-and-loop material, etc., are not usual components of toy figures, and since such permanently-affixed attachment means remains in place in or on the toy when the held object has been removed, such attachment means can detract from the overall play value of the toy.

Prior art cited also limits a toy to holding only an object to which attracting or mating attachment means has been permanently affixed. If more than one object is to be releasably attached to a doll or other toy figure, each object must have corresponding attachment means affixed to it. Thus, Schiavo et al discloses hook-and-loop material on three objects to be held by the doll: a pen, a card, and another doll.

Furthermore, inasmuch as attachment means permanently affixed to an object could render that object unsuitable for other uses, each object of a toy assembly to which attachment means has been permanently affixed is presumably changed in nature and useless or devalued for other purposes.

OBJECTS AND ADVANTAGES

Accordingly, some objects and advantages of my invention are:

(a) to provide a new and improved object-holding accessory which enables a doll or other toy figure to appear to hold an object but which accessory is easily removed from the toy and the held object when play is finished, thus preserving the overall value of the toy for other play and of the object for other uses.

(b) to provide a new and improved object-holding accessory which, since it requires no permanent installation in or on a toy, is transferable and can be used with any number of dolls and toy figures, repeatedly.

(c) to provide a new and improved object-holding accessory which, through elimination of the requirement that attachment means be affixed to an object to be held, enables a doll or toy figure to releasably hold—separately—an almost limitless array of ordinary objects, such as a spoon, a handkerchief, another toy, etc.

(d) to provide a new and improved object-holding accessory which is adjustable and can therefore be used with different-sized dolls and toy figures and can hold objects of various sizes and shapes.

(e) to provide a new and improved object-holding accessory which can be used with dolls and toy figures made of many types of materials, i.e., composition dolls, teddy bears, stuffed dolls, etc., and with objects made of various substances.

(f) to provide a new and improved object-holding accessory which holds an object in a position very like that in which a human encircles an object with thumb and fingers.

(g) to provide a new and improved object-holding accessory which is easy, simple, and safe for a child to play with.

(h) to provide a new and improved object-holding accessory which is inexpensive to manufacture.

Further objects and advantages of my invention will become apparent from a consideration of the drawings and ensuing description.

List of Reference Numberals

| | | | |
|---|---|---|---|
| 10. | First strap | 16. | Inner side |
| 10'. | Second strap | 18. | Outer side |
| 12a. | First end section | 20. | Button |
| 12b. | Second end section | 22. | Stem |
| 14. | Main section (first strap) | 24. | Crown |
| | | 26a & 26b. | Slits |
| 14'. | Main section (second strap) | 27a, 27b, & 27c. | Perforations |

SUMMARY

The new and improved object-holding accessory of this invention enables a doll or other toy figure to appear to hold an object in its hand in a realistic manner; is removable from the doll and from the object; is transferable to any number of toy figures and objects of various materials, sizes, and shapes; is harmless to and maintains the value of the dolls and objects with which it is used; is easy, simple, and safe for a child to play with; and is inexpensive to manufacture.

Description—FIG. 1*a* through FIG. 4

The object-holding accessory of this invention is comprised of two or more interlocking or connecting straps. In its preferred embodiment, the straps are identical in configuration except that one strap has two slits and the other strap has no slits. In manufacture, the straps may vary in length.

A first strap is fastened around the hand of a doll or toy figure and a second strap is fastened around the object to be juxtaposed to the hand of the toy. The straps interlock at right angles and the interlocked connection is positioned at or near the palm of the toy's hand, thus making the doll or other toy figure appear to be holding the object.

Figures 1A, 1B, 2:
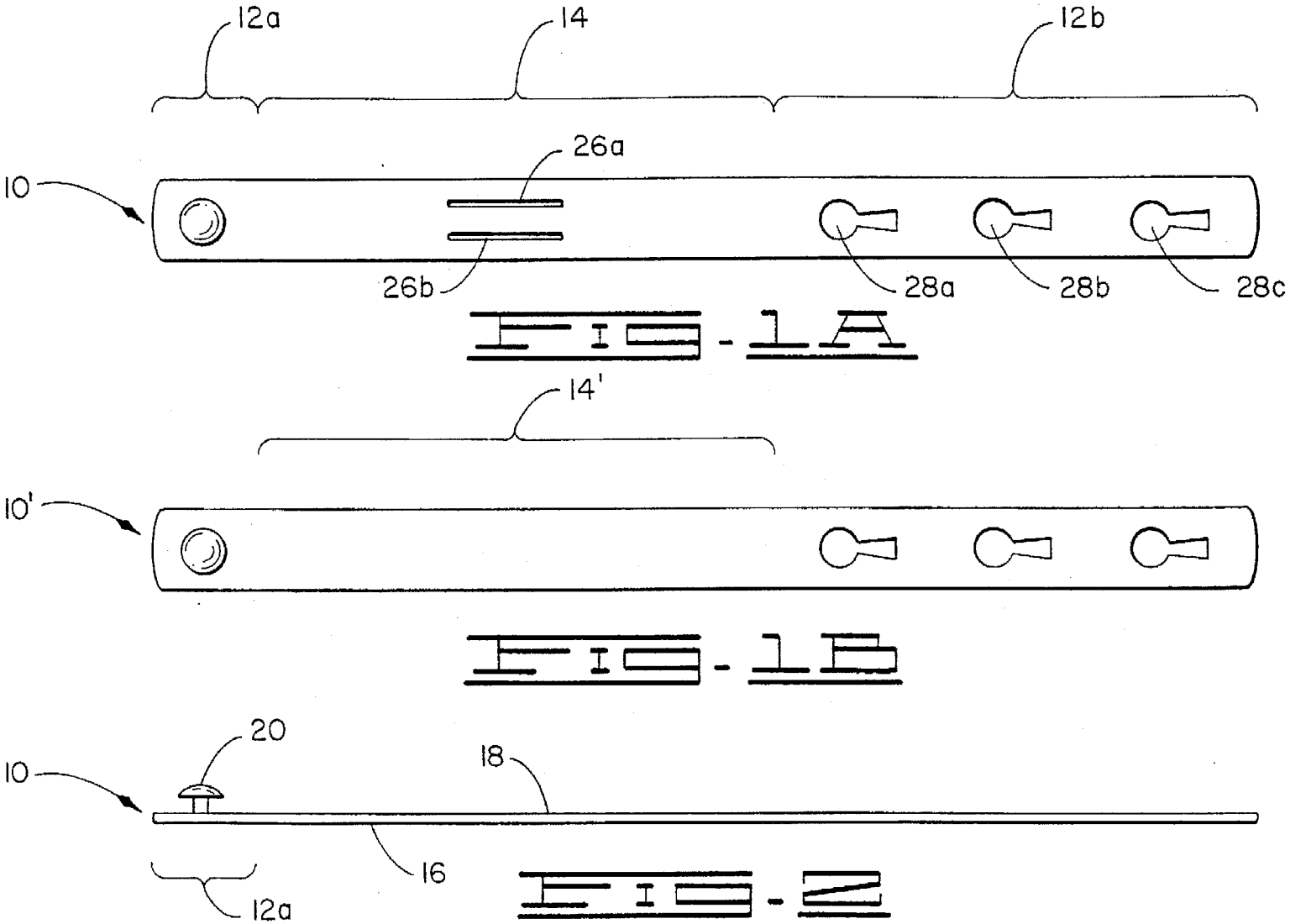
FIGS. 1*a* and 1*b* are top views of the straps of the object-holding accessory.
FIG. 2 is a side view of the strap of FIG. 1*a*.

A first strap 10 and a second strap 10' are pictured in top views in FIGS. 1*a* and 1*b*, respectively. Since straps 10 and strap 10' are identical in all respects except that second strap 10' has no slits, I will describe first strap 10 completely and that description will apply to second strap 10' except where the difference is specifically noted.

Strap 10 is longitudinally elongated in configuration, and is made of a thin, tough, tear-resistant, flexible material that can conform to the shape of the object around which it is snugly fastened. The preferred material for strap 10 in this embodiment is stretch-resistant plastic, which may be reinforced (not shown) around the edges and at the button, slit, and perforation locations hereinafter described.

As shown in FIG. 1*a*, strap 10 is comprised of three longitudinally contiguous sections: a first end section 12*a*, in which one component of a mating fastening assembly is located; a main section 14, intended to encompass a doll's hand or an object; and a second end section 12*b*, in which the second component of the fastening assembly is located and in which end section provision is made for adjustment of fit.

As shown in FIG. 1*b*, second strap 10' is identical to first strap 10 of FIG. 1*a* in all respects except that second strap 10' has no slits in its main section 14'.

It is anticipated that straps 10 and 10' will be manufactured in a number of sizes (lengths), with varying sizes being included in one package. Such sizing may be accomplished by lengthening main sections 14 and 14'.

As shown in FIG. 2, strap 10 has an inner side 16, which is placed in contact with the toy or object, and an outer side 18, which has a mushroom-shaped button 20 as part of a mating assembly for fastening strap 10. Button 20 is permanently disposed outwardly in first end section 12*a* of strap 10 and has a stem 22 and a crown 24, as shown in greater detail in FIG. 3.

Returning to FIG. 1*a*, main section 14 of strap 10 contains slit 26*a* and slit 26*b* which extend lengthwise in main section 14, are slightly longer than the width of strap 10, and are positioned parallel to each other at or near the center of main section 14's length. Slits 26*a* and 26*b* extend through inner side 16 and outer side 18 of strap 10, and are used for interlocking straps 10 and 10'

Second end section 12*b* of strap 10 contains three keyhole-shaped perforations; perforation 28*a*, perforation 28*b*, and perforation 28*c*. Perforations 28*a*, 28*b*, and 28*c* extend through inner side 16 and outer side 18 of strap 10. Button 20 can mate with perforation 28*a*, perforation 28*b*, or perforation 28*c* to form an interlocking relationship. The circular-shaped portions of perforations 28*a*, 28*b*, and 28*c* are sized to accommodate crown 24 of button 20, and the slot-shaped portions of perforations 28*a*, 28*b*, and 28*c* are sized and shaped to releasably capture and accommodate stem 22 of button 20. The provision of a plurality of perforations renders straps 10 and 10' adjustable so as to secure a snug fit around the toy and the object.

Figure 3:
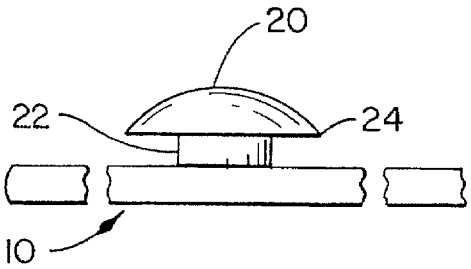
FIG. 3 is an enlarged view of the button which is one component of the fastening assembly of the strap of FIG. 1*a*.

FIG. 3 shows button 20 in greater detail. Button 20 is semi-rigid, and stem 22 of button 20 is unreleasably secured to strap 10, preferably by molding. However, the means for securing button 20 to strap 10 may be selected from a group means for securing which includes riveting and fusing or a combination thereof.

Figure 4:
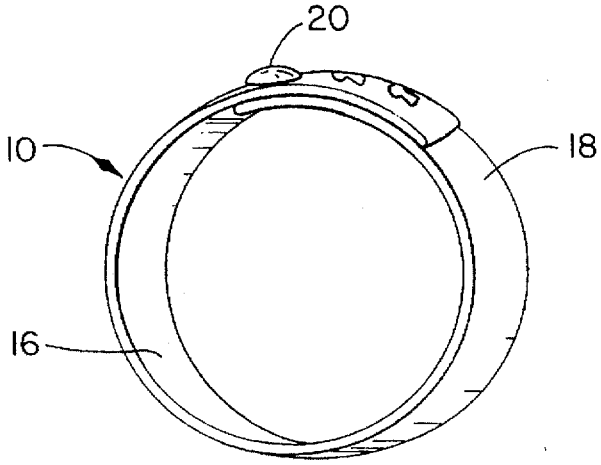
FIG. 4 is a perspective view of the strap of FIG. 1*a*, fastened in a loop configuration.

FIG. 4 is a perspective view of strap 10, fastened in a loop configuration with strap 10's button 20 engaged by perforation 28*a*, which closure is described more fully in the Operation Section below.

Figure 5:
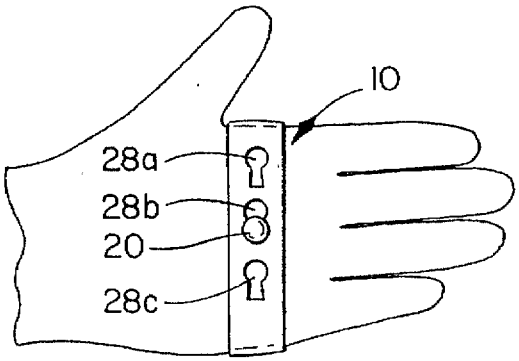
FIGS. 5 and 6 are views of the strap of FIG. 1*a*, positioned on a doll's hand.
Figure 6:
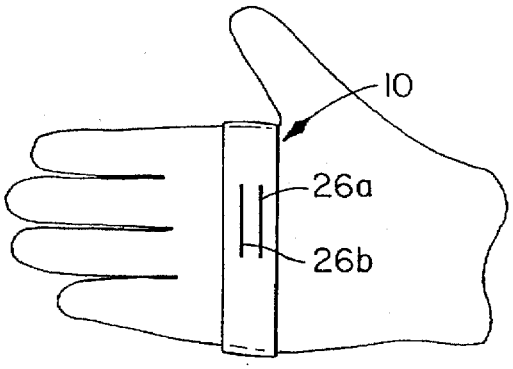
Figure 7:
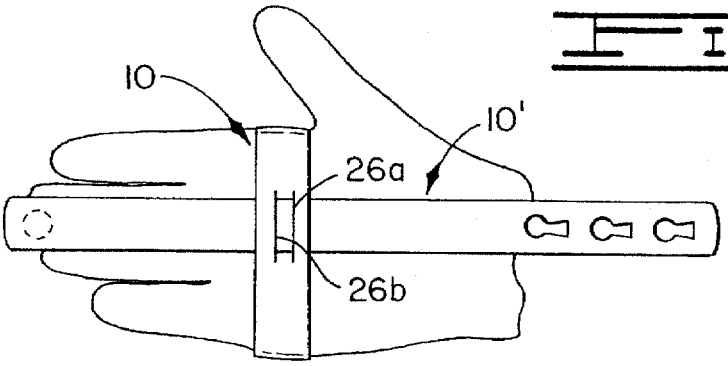
FIG. 7 is a top view of how the two straps interlock to form the object-holding accessory.

Operation of Invention—FIGS. 5 through 7

FIG. 5 shows strap 10 fastened at the back of a doll's hand. Strap 10 is placed around the doll's hand so that second end section 12*b* overlaps first end section 12*a*. Crown 24 of button 20 is disposed through the circular-shaped portion of that perforation which provides strap 10 the snuggest fit—in this illustration, it is perforation 28*b*. Strap 10 is then adjusted so that stem 22 of button 20 is engaged by the slot-shaped portion of perforation 28*b*; the tension of the snug fit assists in holding stem 22 in place in the slot-shaped portion of perforation 28*b*.

Unfastening strap 10 is accomplished by reversing the above procedure. The simplicity of the closure makes it easy for a child to use.

FIG. 6 shows strap 10 as it appears on the inside of the doll's hand. Slits 26*a* and 26*b* of main section 14 are positioned at the palm area of the hand, vertically to the doll's fingers.

FIG. 7 shows second strap 10' interlocked with first strap 10 through slits 26*a* and 26*b* of strap 10. When interlocked with first strap 10, second strap 10' is held in a horizontal position in relation to the doll's fingers. Since strap 10' is to be fastened around an object, the horizontal position of strap 10' insures that the object will be held in a position very like that in which human fingers and thumb would encircle the object.

Second strap 10' is fastened around the object (not shown) by the same process used to fasten first strap 10 around the doll's hand. (If desired, straps 10 and 10' can be interlocked before the straps are disposed around the doll's hand and the object.)

It should be noted that straps 10 and 10' can be attached end-to-end to form longer straps as needed, by engaging button 20 of one strap 10 or 10' in perforation 28*a*, 28*b*, or 28*c* of another strap 10 or 10'.

A variation of the preferred embodiment herein could utilize slits in main section 14' of strap 10', in addition to slits 26*a* and 26*b* in main section 14 of strap 10. The slits in main section 14' of strap 10' could be set at an angle so that instead of straps 10 and 10' interlocking at right angles as they do through slits 26*a* and 26*b* on strap 10 (see FIG. 7), they could interlock through the angled slits on strap 10' if that position would be a more natural-appearing one for whatever object was being held.

In other variations, portions of main sections 14 and 14' of straps 10 and 10' could be releasably connected by any one of a number of mating attachment methods; for example, by another button and perforation arrangement, by a sticky substance, etc. Also, portions of main sections 14 and 14' could be unreleasably joined, as by fusing.

Other Embodiments

Other embodiments of my object-holding accessory for dolls could be made of the same material as the preferred embodiment but could utilize a variety of fastening assemblies. For example:

Instead of button 20, first end section 12*a* of strap 10 could contain a slot. Second end section 12*b* could have notched edges instead of perforations 28*a*, 28*b*, and 28*c*. In this embodiment, when first and second end sections 12*a* and 12*b* were overlapped, the notched edges of second end section 12*b* could be captured and releasably held in the slot of first end section 12*a*.

In another embodiment, second end section 12*b* of strap 10 could be comprised of a series of beads on a narrow "string"; the string could be captured by a slot in first end section 12*a* and releasably held in place by the next bead.

Embodiments Made of Different Materials

Other embodiments of my object-holding accessory for dolls could be made of a variety of flexible materials. For example:

Straps 10 and 10' could be made of a woven or knit fabric, and the fastening assembly could be hook-and-loop material, hooks-and-eyes, snap fasteners, etc. Or the fastening assembly could be as simple as strips of material or ribbon extending from first and second end sections 12*a* and 12*b*, which material or ribbon could be tied together to enclose the doll's hand or the object.

Portions of main sections 14 and 14' of straps 10 and 10' could be connected or joined by one of the releasable attachment devices mentioned above: hook-and-loop material, hooks-and-eyes, snap fasteners, etc., or could be unreleasably joined, as by sewing.

In another embodiment, straps 10 and 10' could be made of a stretchable fabric material commnonly known as "elastic," and could either be fastened with releasable fastening means or permanently closed in a reshapable loop configuration. Portions of the main sections of the two elastic straps could be releasably connected by a fastening method mentioned above, or could be unreleasably joined.

Summary, Ramifications, and Scope of Invention

Accordingly, the reader will see that the concept of this invention provides a number of variations for an accessary by which a doll or other toy figure can be made to appear to hold an object in its hand in a realistic manner. In its many possible forms, the new and improved object-holding accessory described herein:

. . . is easily removed from the toy and the held object when play is finished, thus preserving the overall value of the toy for other play and of the object for other uses.

. . . is transferable and can be used with any number of dolls and toy figures, repeatedly.

. . . enables a doll or toy figure to releasably hold—separately—an almost limitless array of ordinary objects.

. . . is adjustable and can therefore be used with different sized dolls and toy figures and can hold objects of various sizes and shapes.

. . . can be used with dolls and toy figures made of many types of materials and with objects made of various substances.

. . . holds an object in a position very like that in which a human encircles an object with thumb and fingers.

. . . is easy, simple, and safe for a child to play with.

. . . is inexpensive to manufacture.

Although the object-holding accessory is referred to herein as juxtaposing an object to the hand of a toy figure, the accessory could also be used for holding an object in juxtaposition to another part of a toy's body, such as an arm, leg, around the waist, etc. This specification is intended to cover all such uses of the object-holding accessory.

While there is shown and described herein certain specific structure embodying the accessory and its features, it will be manifest to those skilled in the art that various modifications and rearrangements of the parts may be made without departing from the spirit and scope of the underlying inventive concept and that the same is not limited to the particular forms and materials herein shown and described. Thus, the scope of the invention should be determined by the appended claims and their legal equivalents, rather than by the examples given.

I claim:

1. A method for attaching an object to a toy, comprising the steps of:

selecting one of a plurality of toys;

selecting one of a plurality of objects;

releasably encircling a portion of the selected toy with a first elongated flexible strap;

adjusting the first strap to snugly and releasably engage the encircled portion of the selected toy;

interlocking a second flexible strap with the first strap at right angles to the first strap;

releasably encircling a portion of the selected object with the second strap;

adjusting the second strap to snugly and releasably engage the selected object whereby the selected object is releasably and snugly attached to the selected toy; and wherein the selected toy is a doll representative of a human having a hand and wherein the portion of the toy encircled by the first strap is the palm of the hand so that the selected object appears to be held snugly in the hand of the doll.

2. The method of claim 1 wherein the first strap has a mid-portion and wherein the mid-portion is provided with a pair of parallel longitudinal slits sized to slidingly receive the second strap, and wherein the step of interlocking the second strap to the first strap is carried out by threading the second strap through the parallel longitudinal slits in the mid-portion of the first strap thereby providing a sliding engagement between the first strap and the second strap.

3. A method for attaching an object to a toy, comprising the steps of:

selecting one of a plurality of toys;

selecting one of a plurality of objects;

releasably encircling a portion of the selected toy with a first elongated flexible strap;

adjusting the first strap to snugly and releasably engage the encircled portion of the selected toy;

interlocking a second flexible strap with the first strap at right angles to the first strap;

releasably encircling a portion of the selected object with the second strap;

adjusting the second strap to snugly and releasably engage the selected object whereby the selected object is releasably and snugly attached to the selected toy; and wherein the selected toy is representative of an animal having a paw and wherein the portion of the toy encircled by the first strap is the paw of the animal so that the selected object appears to be held snugly in the paw of the animal.

4. The method of claim 3 wherein the first strap has a mid-portion and wherein the mid-portion is provided with a pair of parallel longitudinal slits sized to slidingly receive the second strap, and wherein the step of interlocking the second strap to the first strap is carried out by threading the second strap through the parallel longitudinal slits in the mid-portion of the first strap thereby providing a sliding engagement between the first strap and the second strap.

* * * * *